US006142691A

United States Patent [19]

Crosta

[11] Patent Number: 6,142,691

[45] Date of Patent: Nov. 7, 2000

[54] CONTAINMENT AND EXTRACTION DEVICE FOR DOUGHY COSMETICS

[75] Inventor: Sergio Crosta, Varese, Italy

[73] Assignee: Laffon S.p.A., Varese, Italy

[21] Appl. No.: 09/206,244

[22] Filed: Dec. 7, 1998

[30] Foreign Application Priority Data

Dec. 22, 1997 [IT] Italy ..... MI97A2838

[51] Int. Cl.[7] ..... A45D 40/06

[52] U.S. Cl. ..... 401/75; 401/68; 401/82; 401/88; 401/98

[58] Field of Search ..... 401/75, 68, 82, 401/88, 78, 77, 98

[56] References Cited

U.S. PATENT DOCUMENTS

| | | | |
|---|---|---|---|
| 3,771,881 | 11/1973 | Swenson | 401/68 X |
| 4,954,000 | 9/1990 | Gueret | 401/68 |
| 5,230,577 | 7/1993 | Cox et al. | 401/68 |
| 5,277,508 | 1/1994 | Gueret | 401/68 X |
| 5,609,430 | 3/1997 | Mazzola et al. | 401/68 X |
| 5,813,421 | 9/1998 | Wang | 401/68 X |
| 5,879,093 | 3/1999 | Ohba et al. | 401/68 |

*Primary Examiner*—Henry J. Recla
*Assistant Examiner*—Kathleen J. Prunner
*Attorney, Agent, or Firm*—Dennison, Scheiner, Schultz & Wakeman

[57] ABSTRACT

A storage and dispensing device for a doughy cosmetic includes a tubular container, a holder for the cosmetic and a rear cap. The holder includes a front cup for holding the cosmetic and a rear, externally threaded portion which interacts with an internally threaded portion of the container. The rear cap is coupled to the holder such that rotating the rear cap rotates the holder, resulting in forward motion to dispense the cosmetic or rearward motion to store the cosmetic.

9 Claims, 2 Drawing Sheets

CONTAINMENT AND EXTRACTION DEVICE FOR DOUGHY COSMETICS

BACKGROUND OF THE INVENTION

The current patent applies to a containment and extraction device for a type of doughy cosmetics where the doughy mix is translated by a cup forward and backward with respect to a tubular holding plate. The containment and extraction device can feature diameters of various dimensions depending on the type of cosmetics accommodated that could be made, for instance, of a lead, pastel, lipstick, etc. As part of the patent's illustration process, the example reported below describes a lead holder.

Translation of the cup causes the tip of the lead to be extracted from an idle position inside the plate to an external position, ready for use, in which the very lead is used for instance either to correct shades of light or to draw shades, outlines, etc.

So far, the implementation of those types of devices has required the use of five or even six separate components, thus, making both the manufacturing and assembly process relatively expensive.

Moreover, current devices use a tubular plate made up of two parts: a larger diameter rear body, in which a smaller diameter push-rod, out of which the lead juts, clicks. The above-mentioned push-rod extends far out of the rear body of the plate, which basically means that the push-rod tends to bend—with respect to the above-mentioned body—when the product is being used, thus, making the user's operation inaccurate, since the bending is also transmitted to the lead holder cup.

Another disadvantage of current devices lies in the fact that the latter—when sealed—do not ensure a perfectly tight closure (if required) that would prevent the passage of air.

The above feature is definitely restrictive, especially when dealing with cosmetics containing highly volatile substances which quickly evaporate when coming into contact with air, causing the cosmetic to lose its basic characteristics in the process.

In fact, the sealing cap equipped on current devices does not prevent air from passing through the lid opposite the cap and into the space between the plate and the cup.

SUMMARY OF THE INVENTION

The overall scope of the current patent is to overcome any inconvenience linked to currently implemented techniques, by designing a cost-effective containment and extraction device for doughy cosmetics that would require a smaller number of components.

Another aim of the patent is to implement a device in which the lead holder cup remains tightly fastened to its supporting plate, thus, forming a single structure, even when positioned for use.

A subsequent aim of the patent is to implement a device designed to ensure airtight features in order to maintain the basic characteristics of the product throughout the years, even when dealing with highly volatile substances.

These and other objects of the invention can be achieved with a storage and dispensing device formed of three basic components, a tubular container, a holder for the cosmetic and a rear cap. The holder includes a front cup for holding the cosmetic and a rear portion which slidingly interacts with the rear cap, the cap being rotatable to cause rotating motion of the holder. Means are provided for converting rotating motion of the holder into forward or rearward translation of the holder through the container, with forward translation of the holder causing exposure of the cosmetic product and rearward translation of the holder causing retraction of the cosmetic product.

BRIEF DESCRIPTION OF THE DRAWINGS

The structural and functional characteristics of the patent, as well as the advantages featured with respect to currently implemented techniques, will be better understood when analysing the following description, referred to the enclosed block diagrams which report an example of practical implementation of the above patent. These figures are listed below.

DESCRIPTION OF THE PREFERRED EMBODIMENTS

Figure 1:
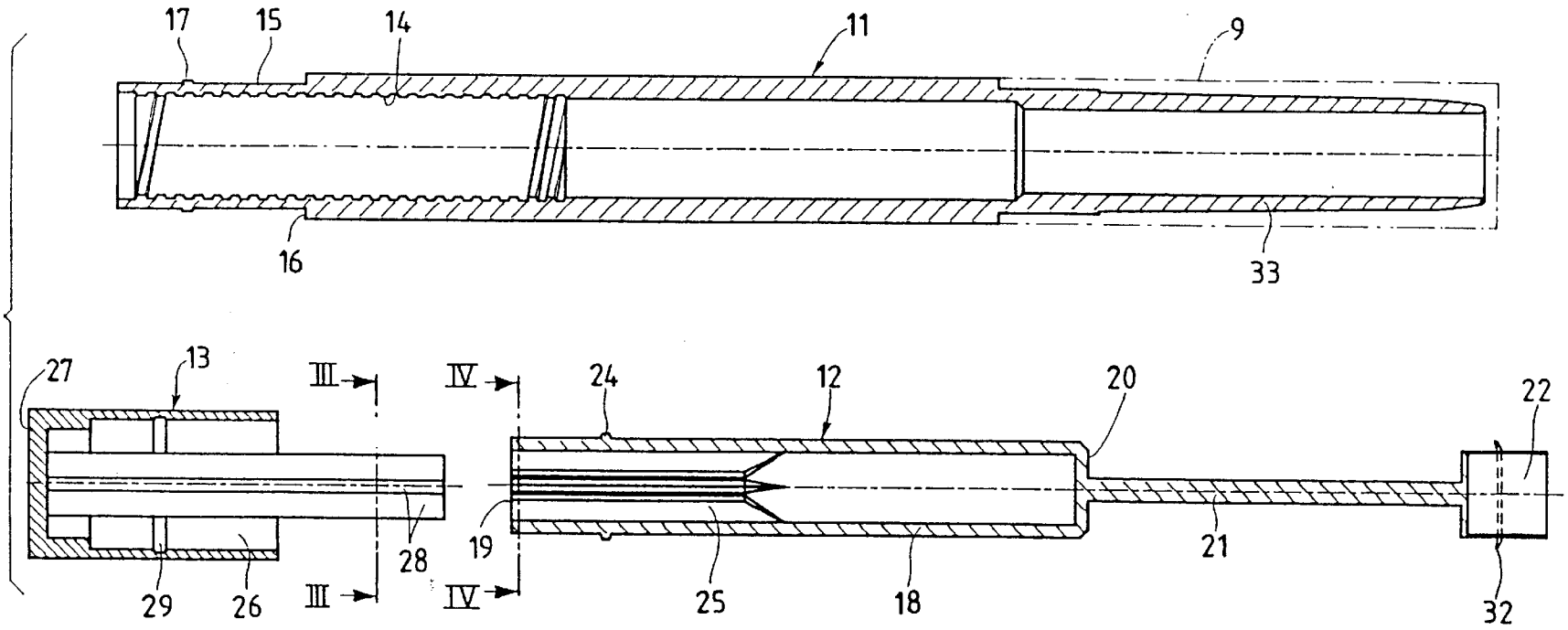
FIG. 1: exploded view, horizontally projected, showing the components of the device as specified by the patent.
Figure 2:
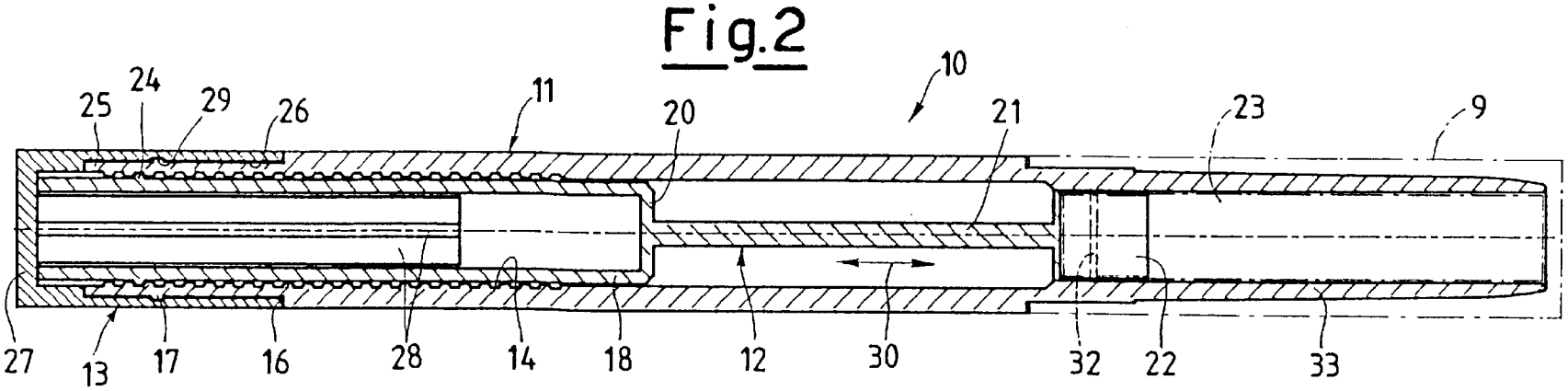
FIG. 2: horizontal projection showing the mounted device.

According to the patent, the containment and extraction device for doughy cosmetics is globally indicated in FIG. 2 by 10; its structure is formed by four modules, namely: a tubular container 11, a lead holder 12, a rear cap 13 and a front cap 9.

As far as the patent is concerned, the three main components are: tubular container 11, lead holder 12 and rear cap 13.

As clearly indicated by the figures, the rear section of the tubular container is internally threaded as in 14. At the front end there is a shoulder which serves as astop for cap 9.

The tubular container 11 extends into a push-rod 33, which is preferably but not necessarily integrally retrieved from the very tubular container 11.

Moreover, the rear of the above-mentioned tubular container 11 ends on a section 15, whose outer layer is reduced, which identifies a ring-like seat or circumferential shoulder 16.

The above-mentioned section 15 also includes a projecting ring-like ledge or external circumferential protuberance 17.

The lead holder 12 consists of an open end 19 hollow cylindrical vessel 18, whose plate 20 (opposite 19) extends into a stem 21 terminated by a cup 22 (friction) for the tip of a doughy product lead 23 shown in FIG. 2.

On the outside, the above-mentioned cylindrical vessel 18, next to the end 19, is equipped with helical screw thread 24 to be coupled to the tubular container 11 built-in inner thread 14.

Finally, inside the vessel 18, four cross-shaped ledges or protuberances 25 (see FIG. 4) that match the open end 19 identify a main seat 31.

Figure 5:
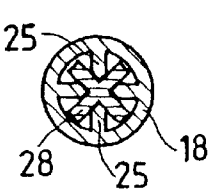
FIG. 5: cross section showing the radial fastening of the lip-cup.
Figure 4:
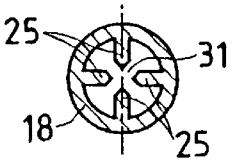
FIG. 4: cross section taken according to the diagram layout IV—IV of FIG. 1.
Figure 3:
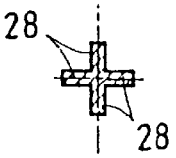
FIG. 3: cross section taken according to the diagram layout III—III of FIG. 1

The structure of the rear cap 13 is formed by an open end hollow cylindrical vessel 26, whose plate 27 extends into a cross-shaped shank 28 jutting out of the open end; its diameter is smaller than the one of the vessel 26 enveloping layer, designed to be secured to the cylindrical vessel 18 of lead holder 12, for the above-mentioned shank 28 to be subsequently inserted into the seat 31, identified by the corresponding cross-shaped ledges (FIGS. 3–5).

The vessel 26 of the rear cap 13 also houses a ring-like throat or internal circumferential recess 29, designed to click in the corresponding ring-like ledge 17 of the section 15 in the tubular container 11.

According to the current patent, a ring-like seal 32, designed to tightly adhere to the inner cylindrical surface of the push-rod 33 of tubular container 11, can be wholly retrieved from the cup 22 (whenever a seal is required). In this way, the—sealed—doughy product 23 is perfectly airtight.

The three components 11, 12, 13 described above are mounted as reported in FIG. 2, i.e., simply by screwing the lead holder 12 in the tubular container 11 and securing it by applying the rear cap 13 as follows: insert the shank 28 into the ledges 25, engage the throat 29 in the ledge 17, with the open end of the rear cap 13 terminated on the seat 16 of tubular container 11.

Needless to say, the coupling process described above which enables the rotation between the lead holder 12 and the rear cap 13 is only reported here as an example and other solutions can be devised to achieve the same results.

The forward and backward motion of the lead holder 12 in the directions indicated by the arrow 30, with corresponding translation towards the tubular container 11, is simply carried out through the rotation of the tubular container 11 towards the rear cap 13, which is fastened to the very lead holder 12 for that purpose.

The scopes, previously introduced in the description, and which consisted in designing a containment and extraction device for doughy cosmetics which is not only airtight, but also implemented with a minimum number of components and in which the lead holder remains tightly fastened to its supporting plate, thus, forming a single structure, even when positioned for use, have definitely been achieved.

Conditions regulating the patent are defined by the following claims.

What is claimed is:

1. A storage and dispensing device for a doughy cosmetic product, consisting essentially of the elements:

a unitary, one-piece generally tubular container having a proximal portion, a central portion and a distal portion;

a unitary one-piece holder for the cosmetic product disposed within the container and comprising a distal portion, a proximal portion including cup means for holding the cosmetic product, the proximal portion of the holder disposed within the container at the proximal portion thereof, and an intermediate portion connecting the proximal portion of the holder with the distal portion of the holder;

a unitary one-piece distal cap which closes the distal portion of the container and slidingly interacts with the distal portion of the holder, said cap being rotatable to cause rotation of the holder; and optionally, a removable proximal cap closing the proximal end of the generally tubular container, the generally tubular container, the holder and the distal cap comprising means for converting rotation of the holder into forward or rearward translation of the holder through the container, forward translation of the holder causing exposure of the cosmetic product and enabling dispensing thereof, and rearward translation of the holder causing retraction of the cosmetic product into the container for storage thereof.

2. Device according to claim 1, wherein the means for converting comprises an internal helical thread in the distal portion of the container and an external helical thread in the distal portion of the holder which interacts therewith.

3. Device according to claim 1, wherein the distal portion of the container includes an end portion of reduced outer diameter, forming thereby a circumferential shoulder, the distal cap being disposed around the end portion and against the shoulder.

4. Device according to claim 3, wherein the end portion comprises an external, circumferential protuberance and the distal cap comprises an internal circumferential recess constructed and arranged to mate with the external protuberance.

5. Device according to claim 1, wherein the proximal portion of the container is of reduced internal diameter, and the cup means has an external diameter selected to seal against the internal diameter of the proximal portion of the container.

6. Device according to claim 1, wherein the distal portion of the holder is in the form of a hollow cylinder, which receives therein an extension of the distal cap, securing the distal cap to the holder and causing rotation of the distal cap to result in rotation of the holder.

7. Device according to claim 6, wherein the hollow cylinder includes four protuberances forming a cross-shape therein, and the extension of the distal cap comprises a shank constructed and arranged to mate with the protuberances, which thereby engage the shank.

8. Device according to claim 1, wherein the proximal portion of the container is of reduced external diameter forming thereby a shoulder, and the device further comprises said removable proximal cap closing the proximal portion of the container and seating against the shoulder.

9. A storage and dispensing device for a doughy cosmetic product, consisting essentially of the elements:

a unitary, one-piece generally tubular container having a proximal end and a distal end, the container being internally threaded at the distal end;

a unitary one-piece holder for the cosmetic product disposed within the container and comprising a distal portion having external threads which interact with the internal threads of the distal end of the container to secure the holder within the container, a proximal portion including cup means for holding the cosmetic product, the proximal portion of the holder disposed within the container at the proximal end thereof, and an intermediate portion connecting the proximal portion of the holder with the distal portion of the holder;

a unitary one-piece distal cap which closes the distal end of the container and interacts with the distal portion of the holder, said cap being rotatable to cause rotation of the holder; and optionally, a removable proximal cap closing the proximal end of the generally tubular container, the rotation of the holder causing forward or rearward translation of the holder through the container, forward translation of the holder causing exposure of the cosmetic product and enabling dispensing thereof, and rearward translation of the holder causing retraction of the cosmetic product into the container for storage thereof.

* * * * *